US005367796A

United States Patent [19]

Bowers et al.

[11] Patent Number: 5,367,796

[45] Date of Patent: Nov. 29, 1994

[54] MULTITOTE CARRIER FOR EXCAVATOR

[76] Inventors: John L. Bowers, 28513 158th Ave. East, Graham, Wash. 98338; Francis E. Jennings, 7402 86th St. East, Puyallup, Wash. 98371

[21] Appl. No.: 769,369

[22] Filed: Oct. 1, 1991

[51] Int. Cl.[5] ..... E02F 3/76

[52] U.S. Cl. ..... 37/410; 37/903

[58] Field of Search ..... 37/117.5, DIG. 12; 172/817, 253

[56] References Cited

U.S. PATENT DOCUMENTS

| | | | |
|---|---|---|---|
| 2,812,595 | 11/1957 | Drott | 37/117.5 |
| 2,824,391 | 2/1958 | Roemer | 37/117.5 |
| 3,072,257 | 1/1963 | Hockenberry | 37/117.5 |
| 3,148,465 | 9/1964 | Beyerstedt et al. | 37/117.5 |
| 3,243,067 | 3/1966 | Artman | 37/117.5 |
| 3,296,720 | 1/1967 | Sagerer | 37/117.5 |
| 3,336,684 | 8/1967 | Ulrich | 37/117.5 |
| 4,566,844 | 1/1986 | Campin | 37/117.5 |
| 4,854,811 | 8/1989 | Veys | 37/117.5 |
| 4,890,400 | 1/1990 | Long | 37/117.5 |
| 4,974,350 | 12/1990 | Puckett | 37/117.5 |

FOREIGN PATENT DOCUMENTS

| | | | |
|---|---|---|---|
| 2165208 | 4/1986 | United Kingdom | 37/117.5 |

*Primary Examiner*—Randolph A. Reese
*Assistant Examiner*—Spencer Warnick
*Attorney, Agent, or Firm*—David L. Tingey

[57] ABSTRACT

A carrier is described that adapts an excavator with an dozer blade to a tote bucket or scoop. The excavator carrier rests on the blade at its bottom with the blade serving as the back of the carrier. Dumping capability is provided by pivoting the carrier on mounting pins between a mounting bracket added to the back of the blade at its top and a corresponding mounting bracket on the carrier. A backhoe on the excavator can be used to lift the front of the carrier causing the carrier to pivot on the mounting pin and dump material through the separation of the the carrier and the blade at its bottom. Side plates of the carrier extend beyond the back of the blade in a shearing action to maintain self alignment. Quick separation of the carrier from the excavator blade is obtained by simply removing mounting pins on which the carrier pivots and using the backhoe to move the carrier conversion away from the excavator or backing the excavator away from the carrier.

5 Claims, 4 Drawing Sheets

MULTITOTE CARRIER FOR EXCAVATOR

BACKGROUND OF THE INVENTION

The present invention relates generally to excavators and, more specifically, to an excavator with a materials carrier mounted to a dozer blade in such a manner that it can be rotated to dump its load.

It is known in the art to have various equipment for movement of soft materials such as dirt and gravel, such as excavators, bulldozers, and graders. Excavators are commonly provided with a dozer blade and a back-hoe. Some models have blades with full orientation adjustment of the blade, such as on axes of yaw, pitch and roll in addition to height adjustment as the blade is raised and lowered on its mounting brace which pivots under hydraulic control at the tractor base. Other models operate with a blade at fixed orientation with only a height adjustment, such as the Kubota Excavator models KH-191, KH-61, KH-007, and others.

These backhoes are useful for a multiplicity of tasks, such as loading, trenching and piling soft material for later movement. Because the volume of material that the backhoe bucket can contain is relatively small, a second vehicle is generally required to transport materials, even for short distances. The backhoe loads the second vehicle, such as a truck, which then carries the material to its new destination. For short transport distances, the cost of employing the second vehicle could be avoided if the excavator dozer blade could be adapted to carry a load. The adapted blade could then be loaded by the backhoe or by moving the adapted blade into the material directly, and the load transported to its destination by the excavator itself, instead of requiring the second vehicle.

It is therefore an object of the present invention to provide a materials carrier mounted to an excavator blade, thereby providing the excavator with a tote means.

Another object of the invention is to provide an excavator carrier that can be optionally removed from the blade so that the blade can be used in its traditional mode or in the new carrier mode.

Still another object of the invention is to provide a dumping capability without the use of hydraulic lines or moving subsystem parts.

Yet another object of the invention is to provide in the excavator carrier a capability of dumping its material by lifting at its front and pivoting the carrier on a horizontal axis at its top, thereby allowing material in the carrier to fall between the rotated carrier and the blade.

A final object is to provide a carrier that maintains self alignment with the excavator blade over extended use.

The above objects are attained in the present invention in a reinforced carrier mounted to an excavator blade with the carrier pivoting on a mounting pin at the top of the blade, leaning against the bottom of the blade in its rest position so that the blade becomes the back side of the carrier. When the backhoe is used to lift the front of the mounted carrier, the carrier pivots upward and material in the carrier falls out its back as it separates from the blade.

SUMMARY OF THE INVENTION

A carrier is described that adapts an excavator with blade and backhoe. The carrier mounted on the excavator blade is useful for toting soft materials loaded with an excavator backhoe or for scooping soft material for toting. Similarly, other items such as bricks, concrete bags, and tools can be loaded and transported. The excavator carrier is removably attached near but below the top of the excavator blade, with the carrier resting on the blade at its bottom with the blade serving as the back of the carrier. Dumping capability is provided in that when the backhoe is used to lift the front of the carrier, the carrier pivots and separates from the blade at the bottom, allowing material inside to fall through the separation. Side plates of the carrier extend beyond the back of the blade toward the excavator tractor in a shearing action to maintain self alignment. Quick separation of the carrier from the excavator blade is obtained by simply removing mounting pins on which the carrier pivots and using the backhoe to move the carrier conversion away from the excavator or simply moving the excavator away from the carrier.

DESCRIPTION OF THE PREFERRED EMBODIMENTS

Figure 2:
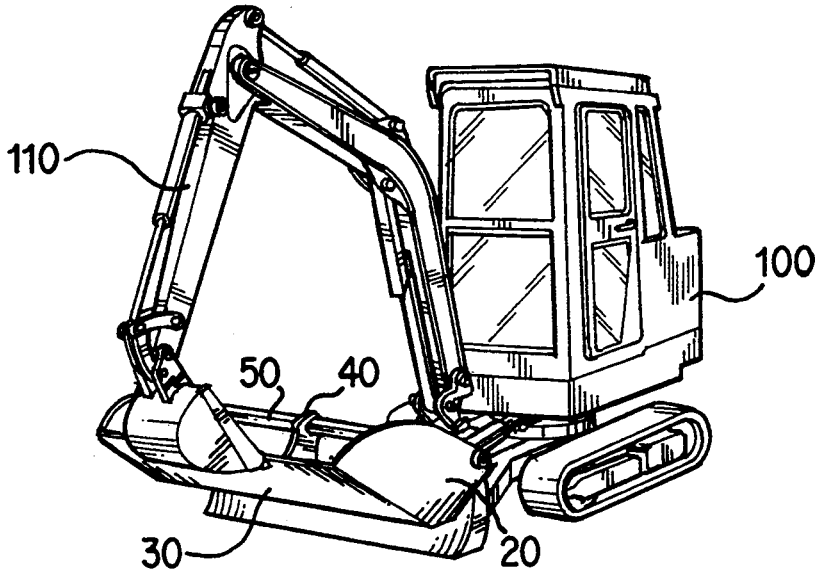
FIG. 2 is a perspective view of the multitote carrier mounted on an excavator with an excavator backhoe lifting the carrier in dumping action.
Figure 1:
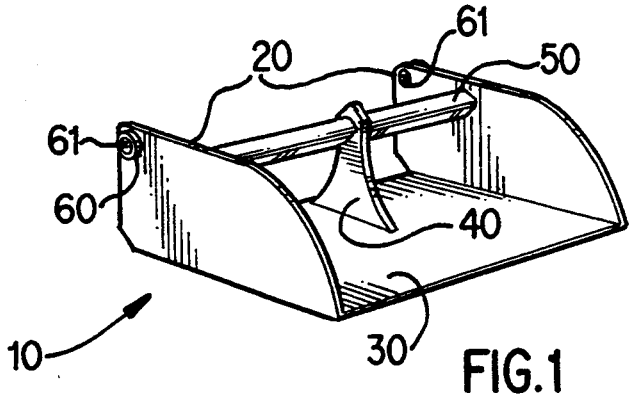
FIG. 1 is a front perspective view of the multitote carrier unattached to an excavator blade.
Figure 5:
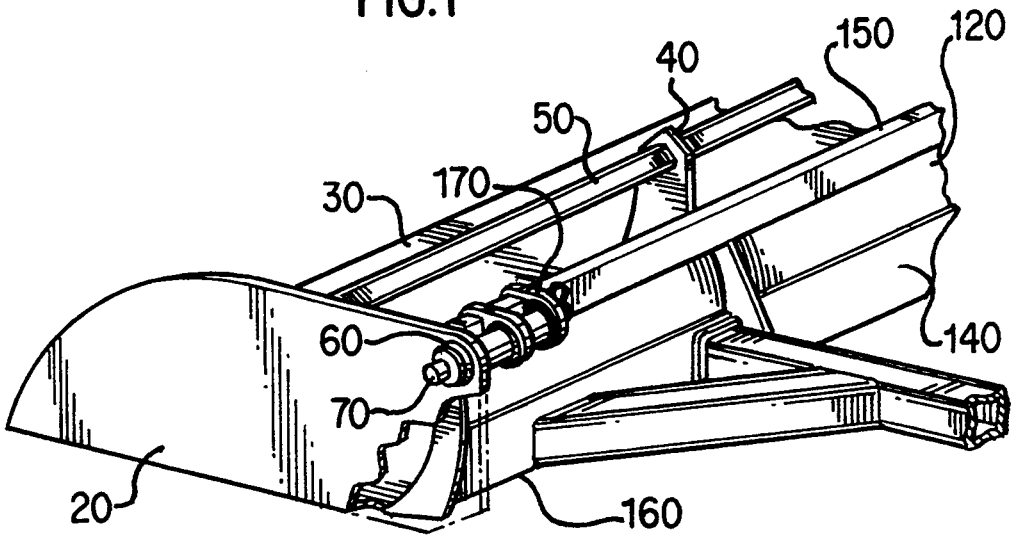
FIG. 5 is a back perspective view of the multitote carrier.
Figure 6:
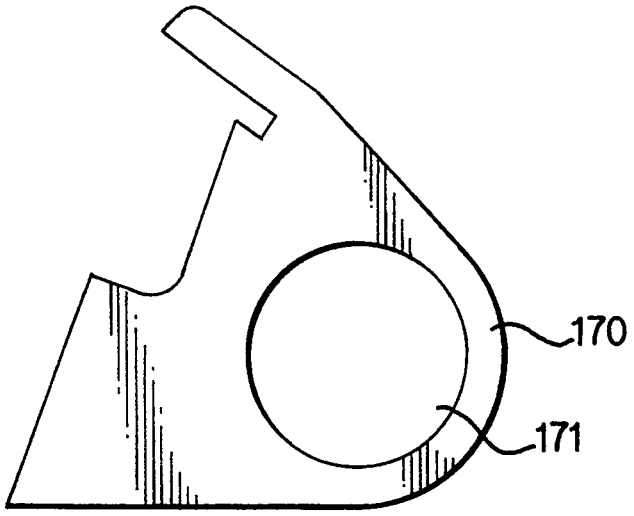
FIG. 6 is a side view of a blade mounting bracket to which the carrier is pivotably attached by means of mounting pins passing through a mounting bracket hole and a matching and aligned hole in the carrier mounting bracket.
Figure 3:
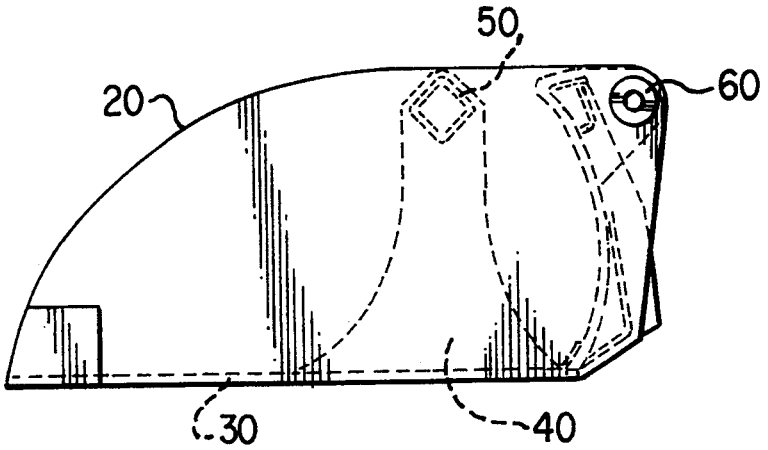
FIG. 3 is a side view of the multitote carrier.
Figure 4:
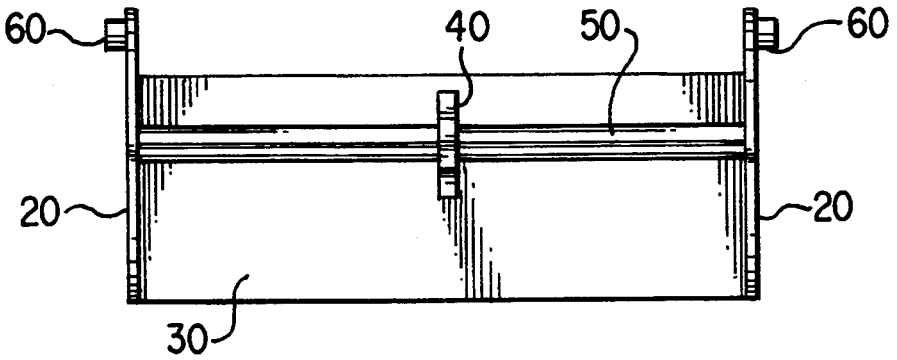
FIG. 4 is a top view of the multitote carrier
Figure 7:
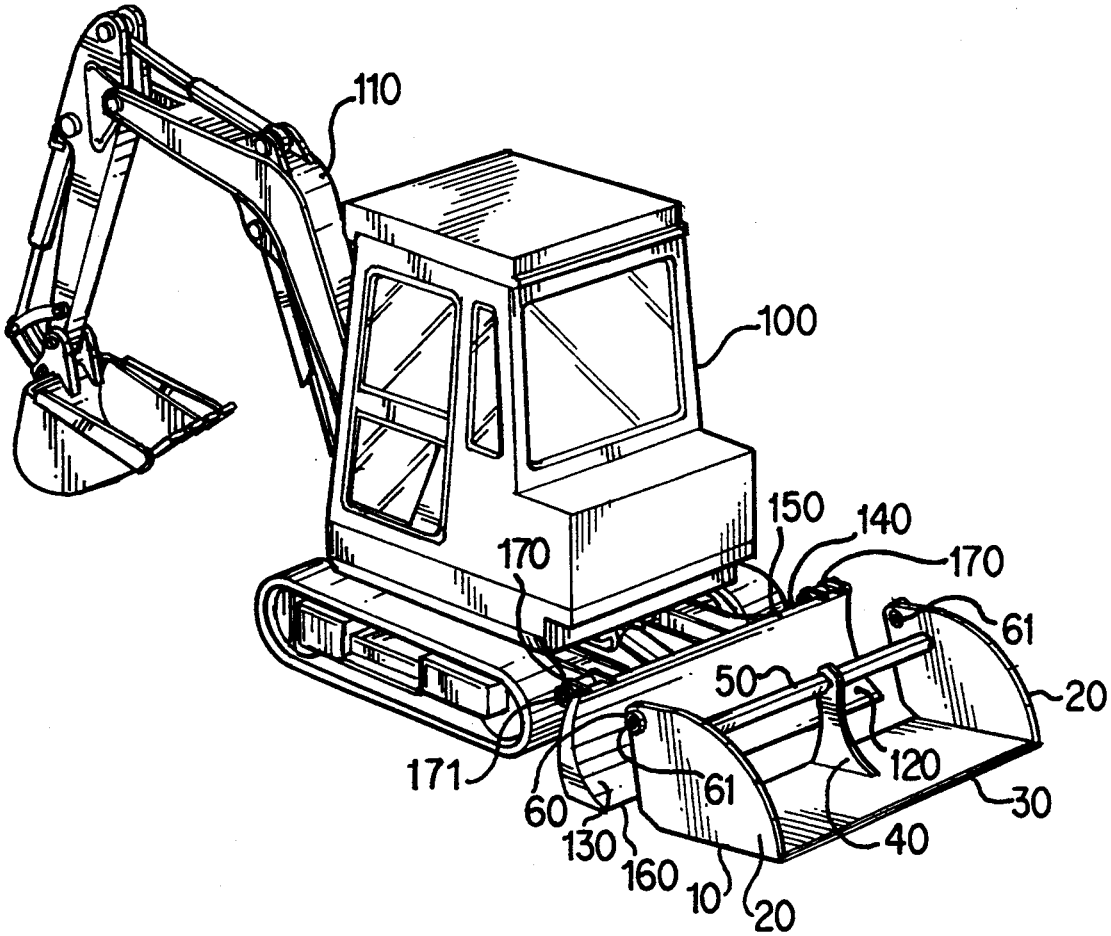
FIG. 7 is a perspective view of a backhoe with blade and the multitote carrier in position to be mounted to the blade.
Figure 8:
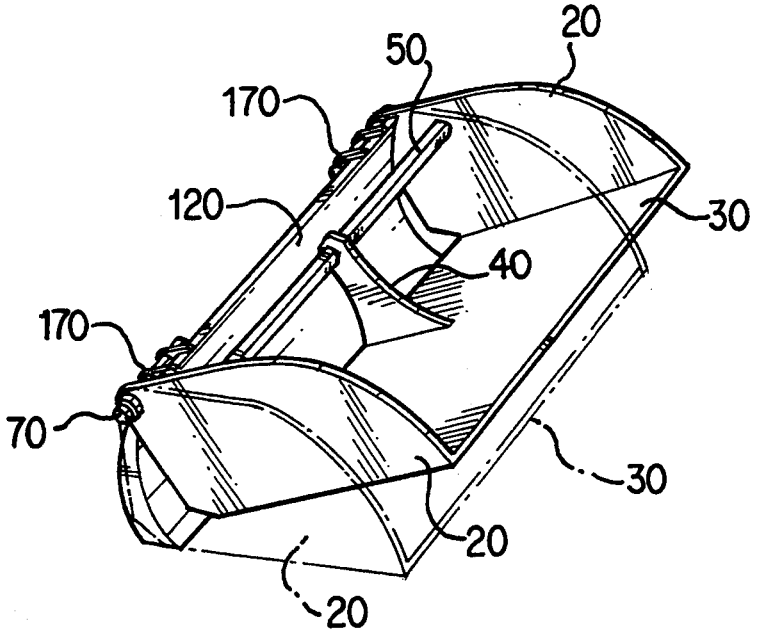
FIG. 8 is a perspective view of the multitote carrier mounted on a blade and in raised position away from the blade, showing a shearing action between the blade sides and the carrier sides which extend behind and outside the blade.

Referring to the Figures, the multitote carrier 10 of this invention adapts an excavator 100 comprising backhoe 110 and blade 120, the blade having opposite front and back surfaces 130 and 140, respectively, a top 150 and a bottom 160. The excavator blade 120 then serves as a carrier bucket with dumping capability. The carrier 10 comprises two upward-extending side plates 20 spaced apart by a horizontal bottom plate 30, the horizontal bottom plate and the side plates together forming a scoop, the front of the horizontal plate forming a leading edge for scooping a load through the carrier front. When the carrier 10 is mounted to the excavator blade 120, the blade front surface 130 becomes a back side of the carrier 10 with the back of the horizontal plate resting against the excavator blade to form a closed bucket during loading.

Affixed to the bottom plate 30 between the side plates 20 are one or more spaced-apart and upward-extending bracing ribs 40 for adding strength to the multitote carrier 10. Attached to the bracing ribs 40 and side plates 20 near their tops is a bracing bar 50 typically extending across the carrier.

The carrier is removably installed on the excavator blade such that the carrier can pivot from a point near but below the top of the blade 120. Characteristically, an independent blade mounting bracket 170 is added, such as by welding, to the top 150 of the blade 120 on its back surface 140. The carrier has a matching mounting bracket 60. Typically, the blade bracket 170 and the carrier mounting bracket 60 have matching and aligned horizontal mounting pin holes 171 and 61, respectively, through which a mounting pin 70 passes. The carrier 10 thereby pivots on the mounting pin 70 with the carrier bottom plate 30 leaning against the blade front surface 130. When so installed on the excavator blade 120, the carrier side plates 20 extend behind the blade 120. Thus, when the carrier is made to swing forward away from and then back against the blade 120, pivoting on the mounting pin 70, the carrier side plates 20 slide along the blade 120 in a scissor-like shearing movement. As opposed to mounting the carrier with a grasping mechanism which could easily become misaligned, for example, by a side bump, the carrier 10 is maintained in self-alignment with the blade 120. The excavator blade and the sides of the carrier maintain a scissor-like shearing relationship even when the blade is maximally spaced from the carrier.

It should be appreciated that dumping action is achieved with the carrier thus mounted on pivot pins. In operation, the carrier is raised (and lowered) in the normal manner of raising and lowering the excavator dozer blade on which it is attached. To dump the carrier, the excavator backhoe is used to lift the carrier causing the carrier to separate from the blade at its bottom. Soft material such as dirt or gravel in the carrier then falls between the blade and the carrier in a typical dumping fashion.

Having described the invention, what is claimed is:

1. A multitote carrier for use in combination with an excavator having a conventional excavator blade, the combination providing a scooping bucket with self-alignment capability and with dumping capability in that when the mounted carrier is lifted, the carrier separates from the excavator blade at the blade bottom for dumping of materials in the carrier, the carrier comprising a horizontal bottom plate, two upward-extending side plates spaced apart by the horizontal bottom plate, the horizontal bottom plate and the side plates together forming a scoop, the front of the horizontal plate forming a leading edge for scooping a load through the carrier front and the back of the horizontal plate resting against the excavator blade to form a closed bucket during loading, means for pivotably mounting the carrier on the excavator blade front surface with a carrier pivot axis located behind the blade back surface and near the blade top with the carrier side plates extending behind the blade and upward to the pivot axis of the mounting means where the side plates are pivotably connected to the blade so that the blade serves as the back side of the bucket, an upward-extending bracing rib affixed to the bottom plate between the side plates for adding strength to the multitote carrier, and a bracing bar attached to the bracing rib.

2. The invention of claim 1 wherein the means for pivotably mounting the multitote carrier on the excavator blade comprises a blade mounting bracket behind the blade mounted to the blade back surface near but below the blade top and having a blade mounting pin hole, a mounting pin, and a matching carrier mounting bracket on the carrier with a matching carrier mounting pin hole in the carrier mounting bracket aligned with the blade mounting pin hole through which the mounting pin passes to pivotably attach the carrier to the blade with the carrier bottom plate resting against the blade front surface.

3. The invention of claim 2 wherein the mounting pin is removable for simple detachment of the multitote carrier from the excavator blade.

4. A multitote carrier for use in combination with an excavator having a conventional excavator blade, the combination providing a scooping bucket with self-alignment capability, the carrier comprising a horizontal bottom plate, two upward-extending side plates spaced apart by the horizontal bottom plate, the horizontal bottom plate and the side plates together forming a scoop for scooping a load through the carrier front, the front of the horizontal plate forming a leading edge in scooping a load and the back of the horizontal plate resting against the excavator blade to form a closed bucket during loading, means for pivotably mounting the carrier on the excavator blade front surface with a carrier pivot axis located behind the blade back surface and near but below the blade top with the carrier side plates extending behind the blade and upward to the pivot axis of the mounting means where the side plates are pivotably connected to the blade so that the blade serves as the back side of the bucket, an upward-extending bracing rib affixed to the bottom plate between the side plates for adding strength to the multitote carrier, a bracing bar attached to the bracing rib and extending between and attached to the carrier side plates.

5. The invention of claim 1 or claim 4 wherein the carrier side plates form sides of the bucket and extend slidably past the blade from the carrier on the front side of the blade to the means for pivotably mounting the carrier side plates behind the blade so that when the carrier is made to swing forward away from and back against the blade, pivoting on the mounting means, the carrier side plates slide past the blade in a self-aligning, scissor-like movement, maintaining the scissor-like relationship between the blade and the carrier sides even when the blade is maximally spaced from the carrier.

* * * * *